US009191730B2

(12) United States Patent
Evans

(10) Patent No.: US 9,191,730 B2
(45) Date of Patent: Nov. 17, 2015

(54) TWO-IN-ONE EAR BUDS WITH A LIGHT-UP CABLE

(71) Applicant: Brittany T. Evans, Fontana, CA (US)

(72) Inventor: Brittany T. Evans, Fontana, CA (US)

( * ) Notice: Subject to any disclaimer, the term of this patent is extended or adjusted under 35 U.S.C. 154(b) by 64 days.

(21) Appl. No.: 14/257,916

(22) Filed: Apr. 21, 2014

(65) Prior Publication Data

US 2014/0314257 A1 Oct. 23, 2014

Related U.S. Application Data

(60) Provisional application No. 61/814,388, filed on Apr. 22, 2013.

(51) Int. Cl.

| | |
|---|---|
| ***H04R 5/02*** | (2006.01) |
| ***H04R 1/10*** | (2006.01) |
| *H04R 27/00* | (2006.01) |

(52) U.S. Cl.

CPC ..... *H04R 1/1041* (2013.01); *H04R 1/1033* (2013.01); *H04R 27/00* (2013.01)

(58) Field of Classification Search

CPC ..... H04R 5/033; H04S 2420/01
USPC ..... 381/309
See application file for complete search history.

(56) References Cited

U.S. PATENT DOCUMENTS

| | | | | |
|---|---|---|---|---|
| 3,984,885 | A | 10/1976 | Yoshimura et al. | |
| 4,821,323 | A | 4/1989 | Papiernik | |
| 5,684,879 | A | 11/1997 | Verdick | |
| 6,001,048 | A | 12/1999 | Taylor | |
| 6,356,644 | B1 | 3/2002 | Pollak | |
| 6,374,126 | B1 | 4/2002 | MacDonald, Jr. et al. | |
| 7,206,429 | B1 | 4/2007 | Vossler | |
| 7,983,437 | B2 | 7/2011 | Wong et al. | |
| 8,480,401 | B2 | 7/2013 | Swain et al. | |
| 2002/0154784 | A1 | 10/2002 | Hsieh | |
| 2005/0054483 | A1 | 3/2005 | Peng | |
| 2005/0192164 | A1 | 9/2005 | Epstein | |
| 2005/0282592 | A1 * | 12/2005 | Frerking et al. | 455/575.2 |
| 2010/0150370 | A1 * | 6/2010 | Bales et al. | 381/74 |
| 2013/0288860 | A1 | 10/2013 | Massey | |
| 2014/0146979 | A1 * | 5/2014 | Puskarich | 381/74 |

* cited by examiner

*Primary Examiner* — Simon King
(74) *Attorney, Agent, or Firm* — Kirk A. Buhler; Buhler & Associates

(57) ABSTRACT

Improvements in ear buds includes a two-in-one ear buds with a light-up cable provides two sets of stereo ear buds that can be joined for a single person to use or separated so the stereo sound can be enjoyed by two people at the same time. The connecting cord is a flat cord with magnetic coupling that joins the cords together to reduce wiring that connects from the audio device to the ear buds. The cable joins a left and a right set of wiring and the ear buds are coupled to provide a single left and right or a pair of left and a pair or right separate ear buds. The cord has illumination LED elements that provide different color patterns to interact with the mp3. The lighting controller gives the user the option to turn the lights on and off with buttons on the controller.

20 Claims, 7 Drawing Sheets

TWO-IN-ONE EAR BUDS WITH A LIGHT-UP CABLE

CROSS REFERENCE TO RELATED APPLICATION

This application claims the benefit of Provisional Application Ser. No. 61/814,388 filed Apr. 22, 2013 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in ear buds. More particularly, the present two-in-one ear buds with a light-up cable provides two pairs of ear buds that allows two people to listen to music and further provides the wiring from the connector to the ear buds to be illuminated and light based upon the music.

2. Description of Related Art Including Information Disclosed Under 37 CFR 1.97 and 1.98:

Many people listen to music or other audio performances though headphones or ear buds that connect to an audio player. For many people that listen to music there is a need to share the audio signal with a friend. Most audio players have a single phone jack, and when the user wants to share the audio signal with another person they must give the other person one of the ear buds and therefor can only listen to half of the stereo signal. The problems with ear buds that are currently available are that the ear buds do not allow the user to share music with their friends. Some people use a "Y" splitter, but this requires the splitter and a separate set of ear buds to share the sound. The use of four ear buds creates four separate sets of ear buds and there is no prior art where the left-left and right-right ear buds can be combined or connected when a single person wants to enjoy the music.

Because there are two sets of ear buds there is a need to reduce the multiple sets of cables that are used with the multiple ear buds. The cable is designed as a flat cable and includes a magnet or multiple magnets that join the pairs (four cables) of left-left and right-right into a joined left and a right set of wiring and the ear buds are coupled to provide a single left and right or a pair of left and a pair or right separate ear buds.

There are a further improvements that where the audio cable has LED lighting that illuminates the cable in sequence with the music. There have been several jump ropes that play music and illuminate with the music. While these patents provide illumination of the jump rope with the music they are not ear buds that can be inserted into the ears and illuminate based upon the music from an audio device.

A number of patents and or publications have been made to address these issues. Exemplary examples of patents and or publication that try to address this/these problem(s) are identified and discussed below.

U.S. Publication number 2002/0154784 was published on Oct. 24, 2002 discloses an Earphone signal Check Device. This publication allows a person to visually check the earphone connection on a cell phone. While this publication provides an LED indicator it does not operate with music to synchronize lighting with the music.

U.S. Publication number 2013/0288860 discloses a jump rope with Lights and Music. The jump rope is a self-contained device the both produces music and lights that flash while the jump rope is being used. This publication does not provide a connection to an external music source and does not provide for the lights to synchronize with the sound.

U.S. Pat. No. 7,983,437 issued on Jul. 19, 2011 to Hammond Wong et al., and discloses an Earphone Set with Detachable Speakers or Subwoofers. While the patent discloses a separable set of speakers it is only operable for use with a single person.

U.S. Pat. No. 8,480,401 issued on Jul. 9, 2013 to Steven Swain et al., and discloses a Multi-User Headset Teaching Apparatus. In this patent the multiple headsets are retained on a base and exist as separate pieces. This patent may show multiple ear pieces, the ear pieces are not connectable so a single user can retain all of the ear buds.

What is needed is a set of ear buds that can be separated to allow two people to listen to stereo music, for the cables to be connectable, and for the cable to include illumination that operates is sequence with the music. The proposed invention provides this solution as a two-in-one light-up ear buds.

BRIEF SUMMARY OF THE INVENTION

It is an object of the two-in-one ear buds with a light-up cable to provide a two sets of stereo ear buds that can be joined for a single person to use or separated so the stereo sound can be enjoyed by two people at the same time. The two in one light up ear buds is similar to a regular pair or ear buds. However the ear buds can magnetically split apart because of its magnetic force when used by two users.

It is another object of the two-in-one ear buds with a light-up cable to avoid the loose hanging cord by using a flat cord where with magnetic coupling that joins the flat cords together to reduce the wiring that connects from the audio device to the ear buds. The cable is designed as a flat cable and includes a magnet or multiple magnets that join the pairs (four cables) of left-left and right-right into a joined left and a right set of wiring and the ear buds are coupled to provide a single left and right or a pair of left and a pair or right separate ear buds. It is important that the magnetic field is a part of this product so that the user can function in their everyday life freely without the ear buds getting in the way.

It is still another object of the two-in-one ear buds with a light-up cable for the wiring and or ear buds to have illumination elements such as LED's that operate to provide different color patterns to interact with the mp3. The ear buds come with a lighting controller that gives the user the option to turn the lights on and off with the top and bottom buttons on the controller. The controller comes with a clip so that it can clip onto a belt. The user(s) can have fun while watching the lights interact with the music or sound.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Description of Item Numbers

10—two-in-one ear buds with a light-up cable

11—Silicon flat cord wire magnetically attaches when there is one user and splits when there is two users.

12—LED lights provide different color patterns to interact with the mp3.

13—The silicon flat cord wiring consists of a volume control on both sides of the earphone wire

14—light control gives users the choice to turn the LED lights on and off

15—Along with the light control, to the left buttons can turn on with the top button and off with the bottom button.

16—With the light control there is a clip, so the user can clip the ear buds to their waist, belt etc.

17—The lining of the ear buds are magnetic so when sandwiched together they can fit like a regular pair of ear buds

18—Outer speaker of ear bud is D shaped, to avoid outside disruptions.

19—Insert for mp3.

20—Is a MP3 player.

21—Is a low pass filter.

22—Is the power supply.

23—Is a power driver that drives the LED's.

24—Control buttons

25—Magnets.

26—Second "friend" ear bud.

Figure 1:
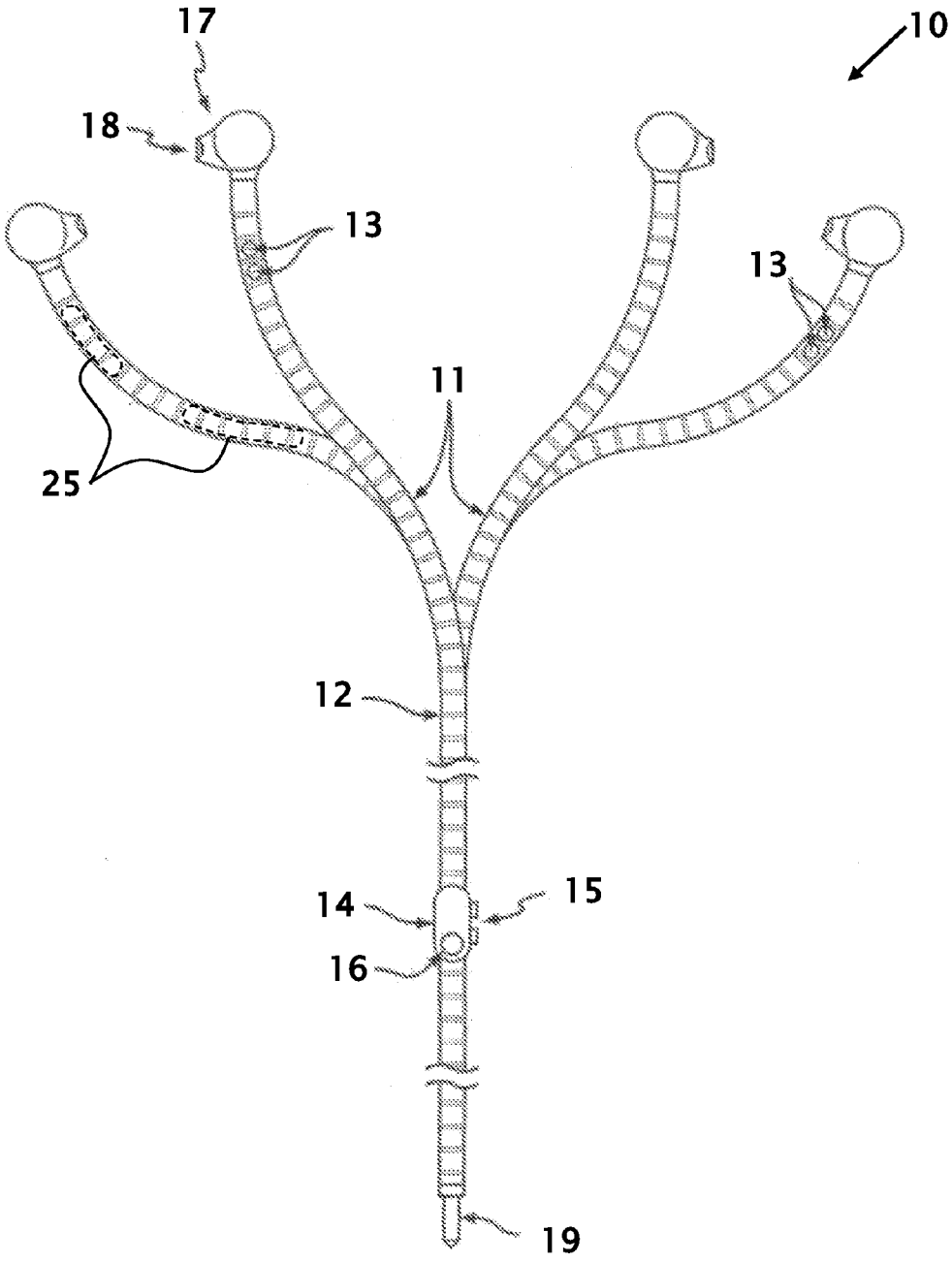
FIG. 1 is a full sized view if the ear buds magnetically split apart.
Figure 2:
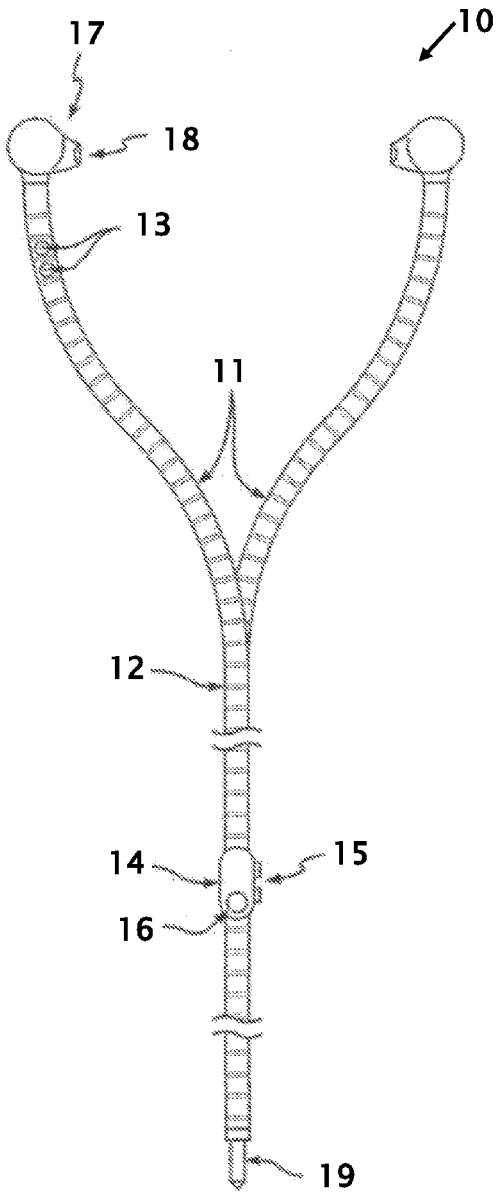
FIG. 2 is a full sized view of the ear buds magnetically together.
Figure 3:
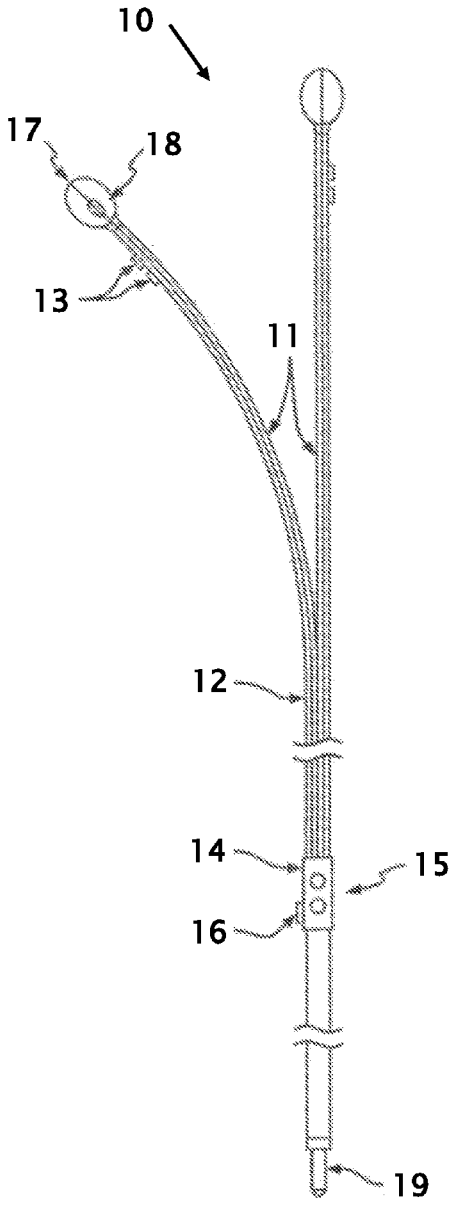
FIG. 3 is a full side view of the ear buds magnetically attached.
Figures 4A, 4B:
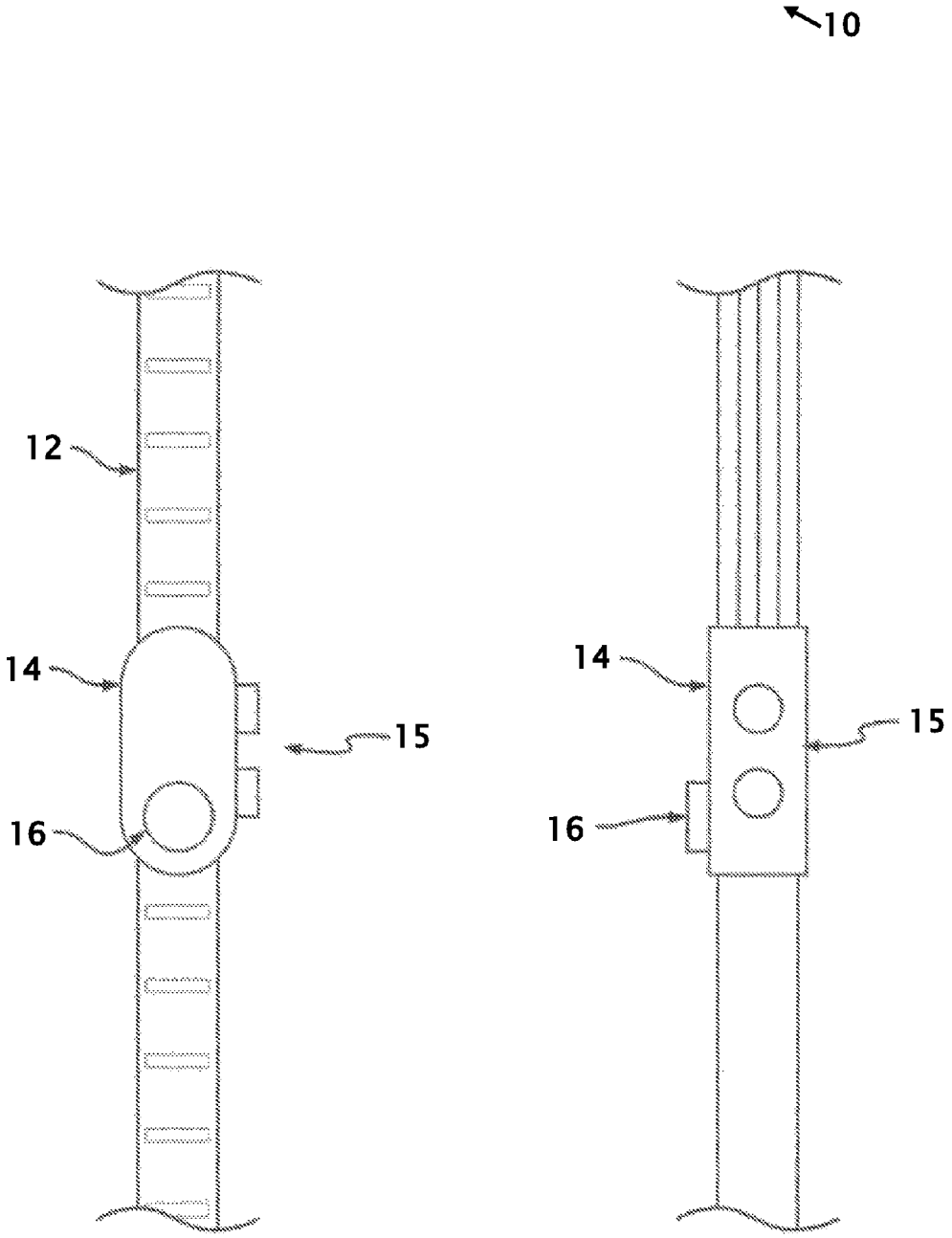
FIGS. 4A and 4B is a front view of a light control and side view.

FIGS. 1-3 show views of the ear buds. In these figures the flat cord 11 made with a jacket of silicone over wires that are magnetic 25 on or within the sides of the flat cord. LED lights 12 are on the inside of the flat cord 11. The clip 15 that is used for the light control operates with compatible mp3 players, phones, computers or tablets and the control clip 15 is made of hard cover plastic material.

Relationship Between the Parts of the Two-in-One Ear Buds with a Light-Up Cable:

There are ten basic parts to the two-in-one ear buds with a light-up cable 10. The flat cord 12 has magnets or a magnet on one side and a ferrite material on the adjoining flat cable. In one embodiment opposing north and south poled magnets 25 are incorporated into opposing flat cables to ensure that left cables join and right cables join and left to right and right to left flat cables from joining. In another contemplated embodiment the left flat cable can have a North Pole and a right cable can have a South Pole. The secondary cables are embedded with a ferrite element of a flat strip or a round wire that is attracted to either the North or the South magnet.

In still another contemplated embodiment the attractive members are spaced apart at intervals of ½ inch, one inch, two inch intervals or some interval that is less than ½ inch, greater than two inches or any interval between ½ inch and two inches. Placing the attractive elements at intervals prevents the magnetic members' 25 form continuously attracting along the entire length of the flat cable 11. The segmented attracting members allows a user to connect the flat cables together at intervals and further allows a user the ability to separate the flat cable at intervals based upon the desire of the user as the flat cable 11 spits between the ears of a user and split between a user and the friend to provide audio entertainment equally for one or two people.

Figure 7:
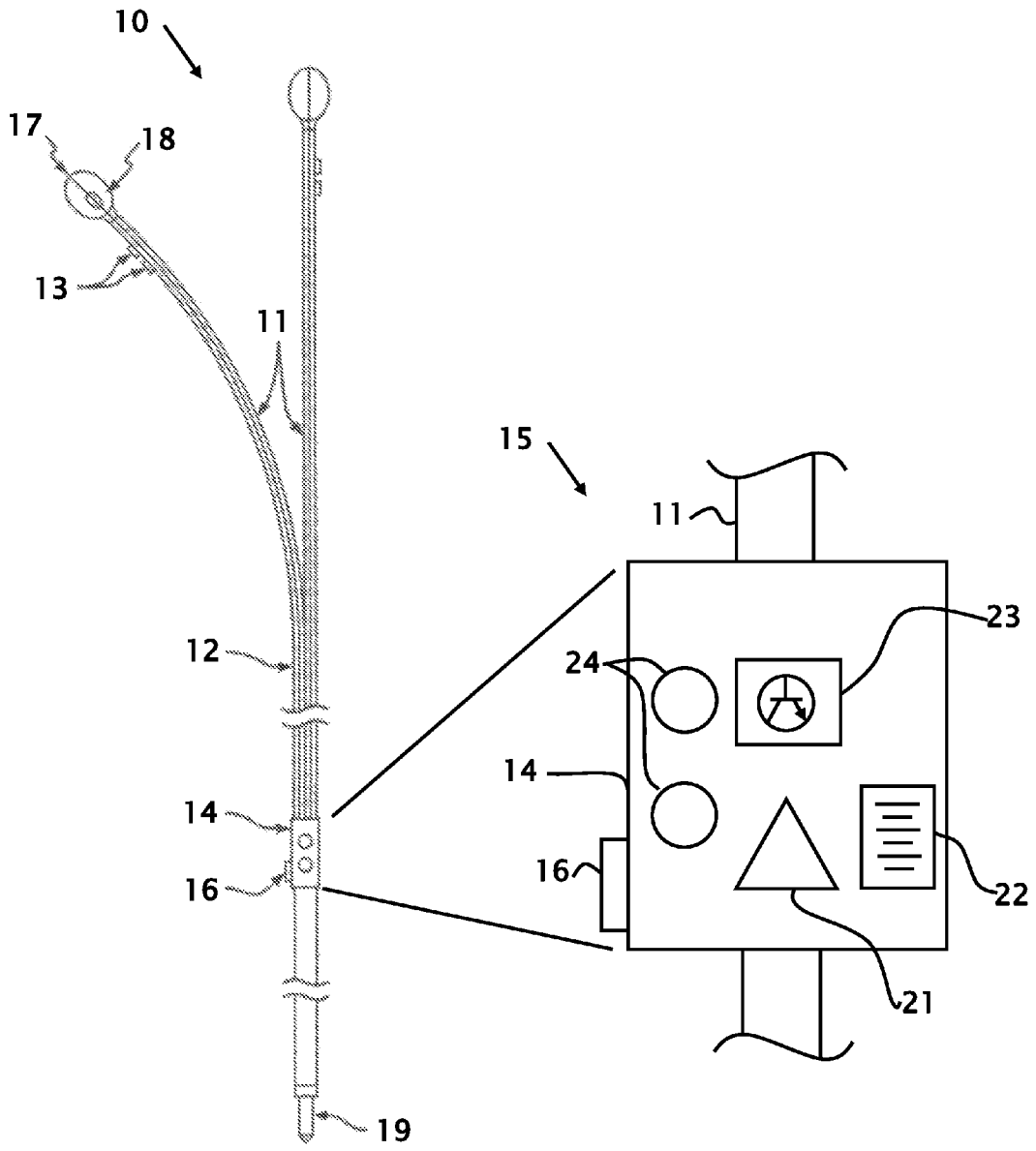
FIG. 7 shows the driver for the LED cable illumination.

The magnetic field operated in conjunction with the silicon plastic cord, which allows the two-in-one light-up ear buds to magnetically attach and detach. The LED lights 12 are controlled by the metered beats that the music would display FIG. 7 shows a contemplated embodiment that shows the circuit that operates with the metered beats.

The volume control 15 is on both sides of the ear bud cables 11 when detached magnetically, and when attached magnetically the volume control 15 is on the left side of the ear buds. The light control 15, allows the user to turn the lighting on and off to the users discretion. There are two buttons top 14 and bottom 16. The top button 14 is used for an on function and the bottom button 16 is used for an off functions. The light control clip 16 gives the user a choice to clip the ear buds to their belt or waist. The outer magnetic lining 17 for the earphones 10. When the cables 11 are sandwiched together the cables 11 can fit in one users' ear. The outer ear bud speakers 18 are "D" shaped so the user can avoid outside disruptions. The insert 19 for an mp3 or equivalent music or audio player.

Figure 5:
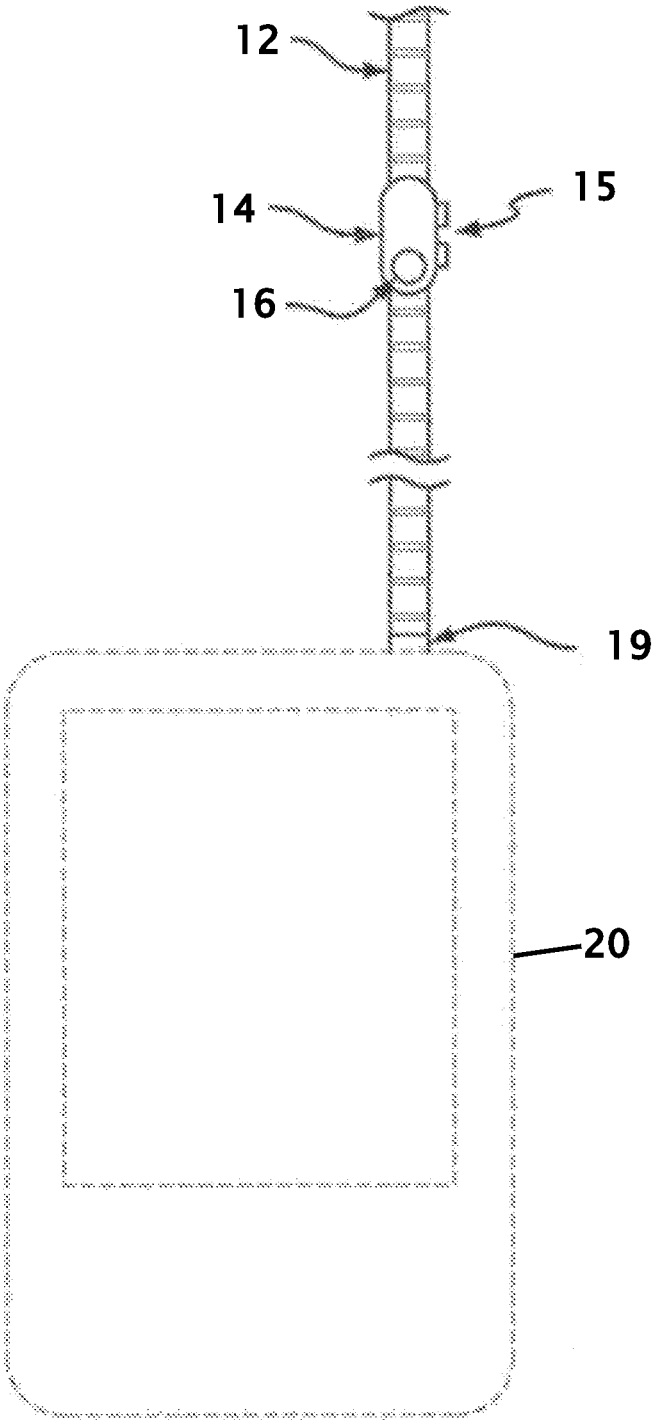
FIG. 5 is a view of the ear buds connected to the mp3
Figure 6A:
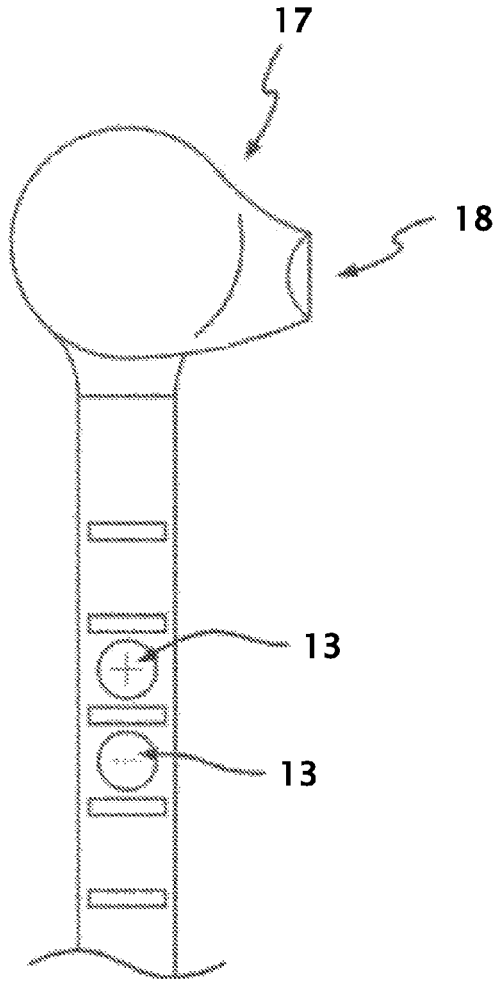
FIGS. 6A and 6B is a view of the front view of the ear buds and side view.
Figure 6B:
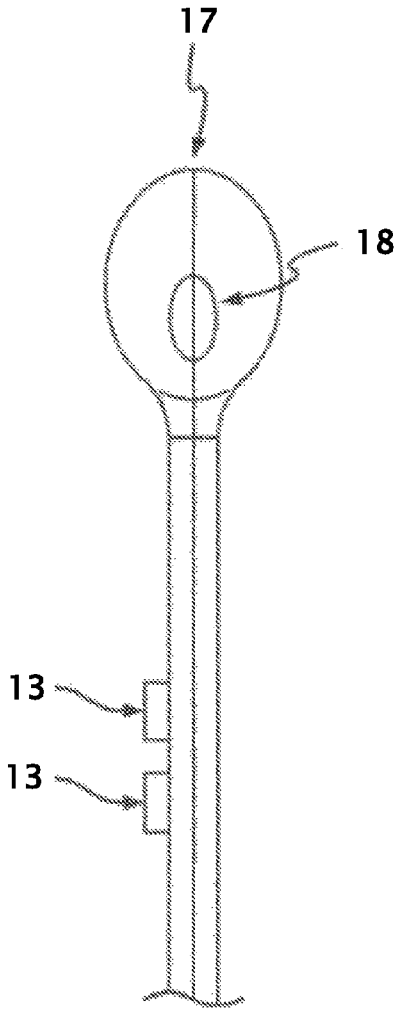

Description of how the Two-in-One Ear Buds with a Light-Up Cable Operates/Functions:

The two-in-one light-up ear buds operates by inserting the ear buds 18 into the mp3 20 (shown in FIG. 5), and when the user plays a song on the mp3 or equivalent player the lighting pattern will interact with the music, which gives the user not only audio entertainment but allows the user(s) to share their music through the ear buds 18.

Unique Features of Two-in-One Ear Buds with a Light-Up Cable:

The unique features of the two-in-one ear buds with a light-up cable is that the two-in-one ear buds with a light-up cable interacts with the music by lighting up into different color patterns, another feature is that the connecting cables 11 are magnetically 25 attaches and detaches when the user sharing the earphones 17 when the user is not sharing the earphones 17.

How to Make the Two-in-One Ear Buds with a Light-Up Cable:

The wiring between the connector 19 and the ear buds 17 is made out of a flat cord 11 made of semi-transparent silicone jacketed wires and magnetic on the outer sides of the flat cord. LED lights 12 are located within the silicon jacket of the flat cord. While the LED's are shown as multiple discreet LED's 12 it is also contemplated that a fiber optic cable could be used with a LED's or a light pipe can be incorporated into the cable to provide lighting along the length of the cord 11. The clip that would be used for the light control working with the mp3 player would be made of hard cover plastic.

FIG. 7 shows the driver for the LED cable illumination. The driver and control for the illumination connects with the incoming connection from the music or audio player. Within the clip 15 is a power supply 22 such as batteries that can be either replaceable or rechargeable. In some contemplated embodiments the audio player can provide sufficient power to drive the LED's. The clip has a low pass filter 21 or other type of audio filter that only passes the desired tone or musical beats to the power driver 23 that drives the LED(s) in the cable 11. The audio processor can also include a microcontroller.

Figure 8A:
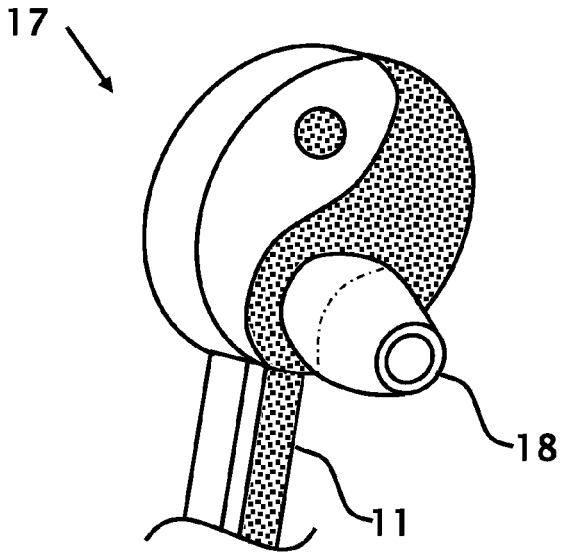
FIGS. 8A and 8B shows an embodiment where the two ear buds are jointed to form a single ear bud.
Figure 8B:
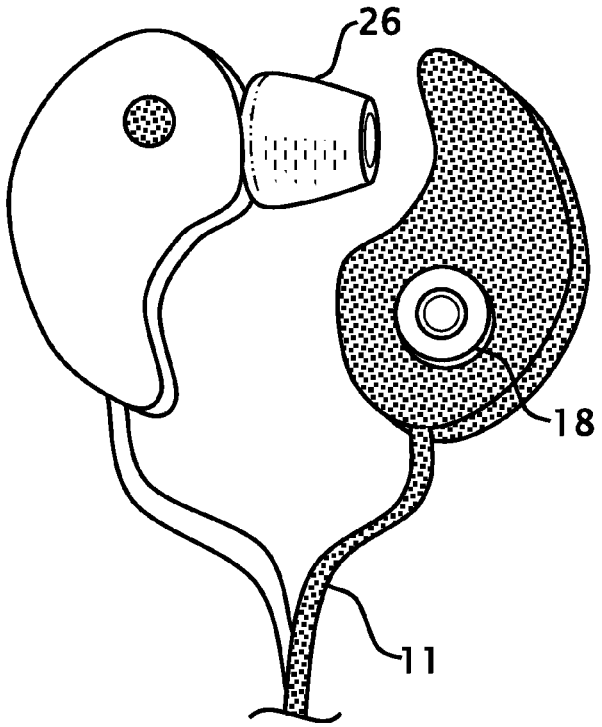

FIGS. 8A and 8B shows another preferred embodiment where the two ear buds are jointed to form a single ear bud. In this embodiment the second or "friend" ear bud 26 nests within the housing of the first or primary ear bud 17. In FIG. 8A the cables 11 are coupled together to form essentially only one left or right cable. In FIG. 8B the cable 11 is show split to provide the two listening buds. As the primary ear bud 18 and the friend ear bud 26 are separated the magnetic coupling or couplings in the cable 11 release to provide two left and or two right cables 11.

Thus, specific embodiments of a two-in-one ear buds with a light-up cable have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A two-in-one ear buds with a light-up cable comprising:
a first right ear bud with a first right cable;
a second right ear bud with a second right cable;
said first right ear bud is configured to securable receive said second right ear bud to form a joined right set;
said first right cable is magnetically coupleable with at least a portion of said second right cable;
a first left ear bud with a first left cable;
a second left ear bud with a second left cable;
said first left ear bud is configured to securable receive said second left ear bud to form a joined left set;
said first left cable is magnetically coupleable with at least a portion of said second left cable;
a left channel audio signal provides a first audio signal to both said first right ear bud and said second right ear bud;
a right channel audio signal provides a second audio signal to both said first left ear bud and said second left ear bud;
an audio connector that connects to said first right ear bud, said second right ear bud, said first left ear bud and said second left ear bud, and
said audio connector further connects to an audio processor that controls at least one illumination element that emits illumination based upon an audio signal delivered to said audio connector.

2. The two-in-one ear buds with a light-up cable according to claim 1 wherein said magnetic coupling is with at least one magnetic element in said first right cable.

3. The two-in-one ear buds with a light-up cable according to claim 2 wherein said magnetic coupling is with at least one magnetic element in said second right cable.

4. The two-in-one ear buds with a light-up cable according to claim 2 wherein said magnetic coupling is with at least ferric element in said second right cable.

5. The two-in-one ear buds with a light-up cable according to claim 3 wherein said magnetic coupling is with at least ferric element in said first right cable.

6. The two-in-one ear buds with a light-up cable according to claim 1 wherein said audio processor includes elements selected from a group consisting of a filter, an amplifier, a power supply, a microprocessor, and a power driver.

7. The two-in-one ear buds with a light-up cable according to claim 1 wherein said illumination is with at least one LED.

8. A two-in-one ear buds comprising:
a first right ear bud with a first right cable;
a second right ear bud with a second right cable;
said first right ear bud is configured to securable receive said second right ear bud to form a joined right set;
said first right cable is magnetically coupleable with at least a portion of said second right cable;
a first left ear bud with a first left cable;
a second left ear bud with a second left cable;
said first left ear bud is configured to securable receive said second left ear bud to form a joined left set;
said first left cable is magnetically coupleable with at least a portion of said second left cable;
a left channel audio signal provides a first audio signal to both said first right ear bud and said second right ear bud;
a right channel audio signal provides a second audio signal to both said first left ear bud and said second left ear bud, and
an audio connector that connects to said first right ear bud, said second right ear bud, said first left ear bud and said second left ear bud.

9. The two-in-one ear buds according to claim 8 wherein said magnetic coupling is with at least one magnetic element in said first right cable.

10. The two-in-one ear buds according to claim 9 wherein said magnetic coupling is with at least one magnetic element in said second right cable.

11. The two-in-one ear buds according to claim 9 wherein said magnetic coupling is with at least ferric element in said second right cable.

12. The two-in-one ear buds according to claim 10 wherein said magnetic coupling is with at least ferric element in said first right cable.

13. The two-in-one ear buds according to claim 8 that further includes at least one illumination element.

14. A two-in-one ear buds comprising:
a first right ear bud with a first right cable;
a second right ear bud with a second right cable;
said first right ear bud is configured to securable receive said second right ear bud to form a joined right set;
a first left ear bud with a first left cable;
a second left ear bud with a second left cable;
said first left ear bud is configured to securable receive said second left ear bud to form a joined left set;
a left channel audio signal provides a first audio signal to both said first right ear bud and said second right ear bud;
a right channel audio signal provides a second audio signal to both said first left ear bud and said second left ear bud, and
an audio connector that connects to said first right ear bud, said second right ear bud, said first left ear bud and said second left ear bud.

15. The two-in-one ear buds according to claim 14 wherein said audio connector further connects to an audio processor that controls at least one illumination element that emits illumination based upon an audio signal delivered to said audio connector.

16. The two-in-one ear buds according to claim 15 wherein said audio processor includes elements selected from a group consisting of a filter, an amplifier, a power supply, and a power driver.

17. The two-in-one ear buds according to claim 16 wherein said illumination is with at least one LED.

18. The two-in-one ear buds according to claim 16 wherein said audio processor further includes user adjustable controls.

19. The two-in-one ear buds according to claim 14 wherein a plurality of LED's placed along at least one of said first left cable, said second left cable, said first right cable or said second right cable.

20. The two-in-one ear buds according to claim 14 wherein said first left cable, said second left cable, said first right cable and said second right cable are flat cables.

* * * * *